US008257103B2

(12) United States Patent
Costa et al.

(10) Patent No.: US 8,257,103 B2
(45) Date of Patent: Sep. 4, 2012

(54) SUBMERSIBLE POTHEAD SYSTEM FOR USE IN A WELL APPLICATION

(75) Inventors: Wayne L. Costa, Edmond, OK (US); Gregory H. Manke, Overland Park, KS (US); Melissa Ver Meer, Shawnee, KS (US)

(73) Assignee: Schlumberger Technology Corporation, Sugar Land, TX (US)

( * ) Notice: Subject to any disclaimer, the term of this patent is extended or adjusted under 35 U.S.C. 154(b) by 259 days.

(21) Appl. No.: 12/628,646

(22) Filed: Dec. 1, 2009

(65) Prior Publication Data

US 2011/0130020 A1 Jun. 2, 2011

(51) Int. Cl.
*H01R 13/52* (2006.01)

(52) U.S. Cl. ..... 439/271

(58) Field of Classification Search ..... 439/271, 439/587, 589, 604

See application file for complete search history.

(56) References Cited

U.S. PATENT DOCUMENTS

| | | | | |
|---|---|---|---|---|
| 3,786,397 | A * | 1/1974 | Bridges | 439/277 |
| 4,387,313 | A * | 6/1983 | Yamamoto et al. | 310/71 |
| 4,679,875 | A * | 7/1987 | Ramsey | 439/604 |
| 5,670,747 | A * | 9/1997 | Lawer et al. | 174/74 R |
| 6,397,945 | B1 * | 6/2002 | Manke et al. | 166/65.1 |
| 6,409,485 | B1 * | 6/2002 | Ebner | 417/423.1 |
| 6,910,870 | B2 | 6/2005 | Ebner | |
| 7,611,339 | B2 * | 11/2009 | Tetzlaff et al. | 417/422 |
| 7,789,689 | B2 * | 9/2010 | Frey et al. | 439/275 |

* cited by examiner

*Primary Examiner* — Jean F Duverne
(74) *Attorney, Agent, or Firm* — Jim Patterson

(57) ABSTRACT

A technique enables protection of electrical conductors in a submerged environment, such as a wellbore environment. A connector system is deployed at the end of an electric cable to enable connection of the electric cable with a submersible component. The connector system comprises a connector body formed of a moldable material that is molded around at least one conductor of the electric cable. The moldable material insulates and protects the at least one conductor when the connector body is engaged with the submersible component.

13 Claims, 3 Drawing Sheets

SUBMERSIBLE POTHEAD SYSTEM FOR USE IN A WELL APPLICATION

BACKGROUND

In a variety of well related applications, electric power is delivered downhole to a submersible component. For example, power cables may be routed down through a wellbore for connection with a submersible motor of an electric submersible pumping system. The lower end of the electric cable is connected with the submersible component by a connector system, often called a pothead system.

Existing pothead systems generally comprise a metal pothead body through which the power cable conductors are routed. Terminal ends of the power cable conductors extend from the pothead body for insertion into corresponding conductor receptacles of the submersible component. Within the metal pothead body, the power cable conductors are surrounded by dielectric insulation, elastomer seals, and compression blocks to protect the functionality of the pothead system. Additional seals can be located between the pothead body and a corresponding housing of the submersible component to further seal and protect the conductive paths. However, such multicomponent pothead systems can be complex, expensive, and susceptible to leaks.

SUMMARY

In general, the present application provides a technique for protecting electrical conductors in a submerged environment, such as a wellbore environment. A connector system is deployed at the end of an electric cable to enable connection of the electric cable with a submersible component. The connector system comprises a connector body formed of a moldable material that is molded around at least one conductor. The moldable material insulates and protects the at least one conductor when the connector body is engaged with the submersible component.

BRIEF DESCRIPTION OF THE DRAWINGS

Certain embodiments will hereafter be described with reference to the accompanying drawings, wherein like reference numerals denote like elements, and.

DETAILED DESCRIPTION

Figure 1:
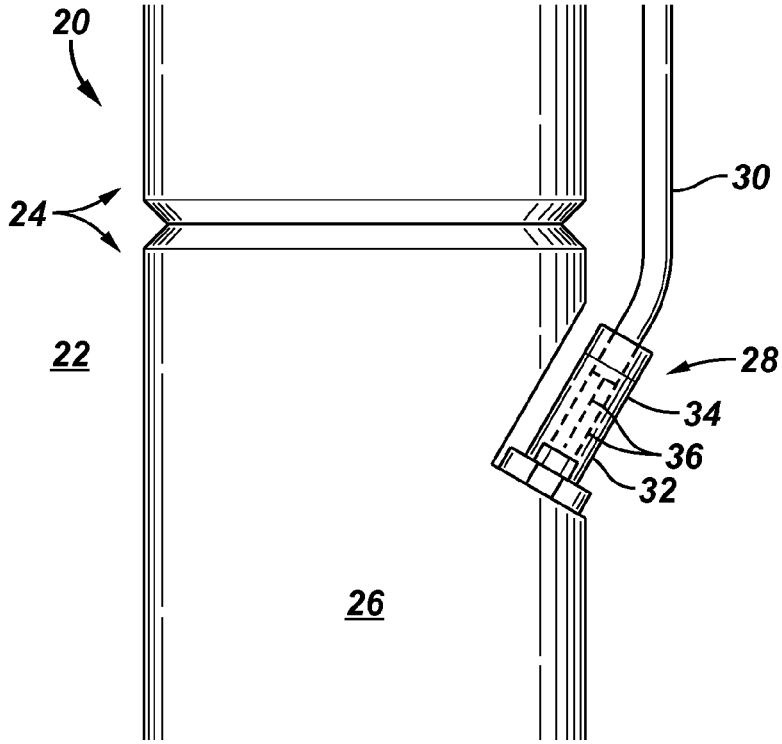
FIG. 1 is a schematic illustration of one example of a connector system engaging an electric cable with a submersible component, according to an embodiment.

In the following description, numerous details are set forth to provide an understanding of various preferred embodiments. However, it will be understood by those of ordinary skill in the art that the embodiments may be practiced without many of these details and that numerous variations or modifications from the described embodiments may be possible.

The present application generally involves a system and methodology related to submerged connections between electrical cables and submersible components. In one embodiment, a connector system is provided for enabling an electrical connection between a power cable and a submersible component, such as an electric, submersible motor. The connector system utilizes a connector, sometimes referred to as a pothead, which simplifies construction, seals against the one or more internal conductors, and facilitates the formation of a seal with the submersible component.

According to one specific example, the connector system comprises a connector body that is molded around each conductor of the electric cable. For example, the connector body may be molded around three conductors of the type used in various downhole power cables. Moldable material is selected and molded around the one or more conductors to provide a pressure seal around each conductor and to provide dielectric insulation without the need for additional components. The molded connector body also provides great resistance to mechanical damage.

The use of moldable material enables formation of the connector body in a variety of configurations. For example, the connector body can be molded into complex shapes that include various features. In one embodiment, the connector body is molded to form a conductor housing/primary body portion, a mounting flange, and a mating portion to enable sealed engagement with the submersible component. The entire connector body may be formed as a single, unitary, molded component. Also, the unitary connector body may be formed around individual conductors or groups of conductors, such as the three conductors found in various power cables used to power three-phase motors.

The moldable material is selected according to the environment in which the pothead/connector system is to be employed. Depending on the application, the connector body may be formed from a thermoplastic material, a thermoset material, a liquid crystal polymer material, or another suitable moldable material. The use of these moldable materials allows the connector body housing to provide a pressure seal with respect to the conductors that prevents the well environment from entering the submersible component, e.g. submersible motor. The material of choice provides the dielectric insulation strength over conductors, e.g. copper conductors. The material also is compatible with the well environment and provides mechanical strength to enable fastening of, e.g. bolting, the connector body to the submersible component. The use of such materials allows creation of connector systems that do not require any additional elastomeric sealing elements because the sealing function is accomplished by the molded connector body.

Referring generally to FIG. 1, a system 20 is illustrated as deployed in a submerged environment 22, such as a downhole environment. In this example, system 20 comprises a plurality of components 24 including a submersible, electric component 26. By way of example, submersible electric component 26 may comprise a submersible motor or other component requiring power in the submerged environment 22.

An electric connection system 28 provides an electrical connection between electric, submersible component 26 and an electric cable 30, e.g. an electric power cable. The electric connection system 28 comprises a connector body 32 formed of a moldable material 34. The moldable material 34 enables formation of connector body 32 in a variety of configurations that sealingly enclose one or more internal conductors 36 extending into the connector body 32 from an end of the electric cable 30.

Figure 2:
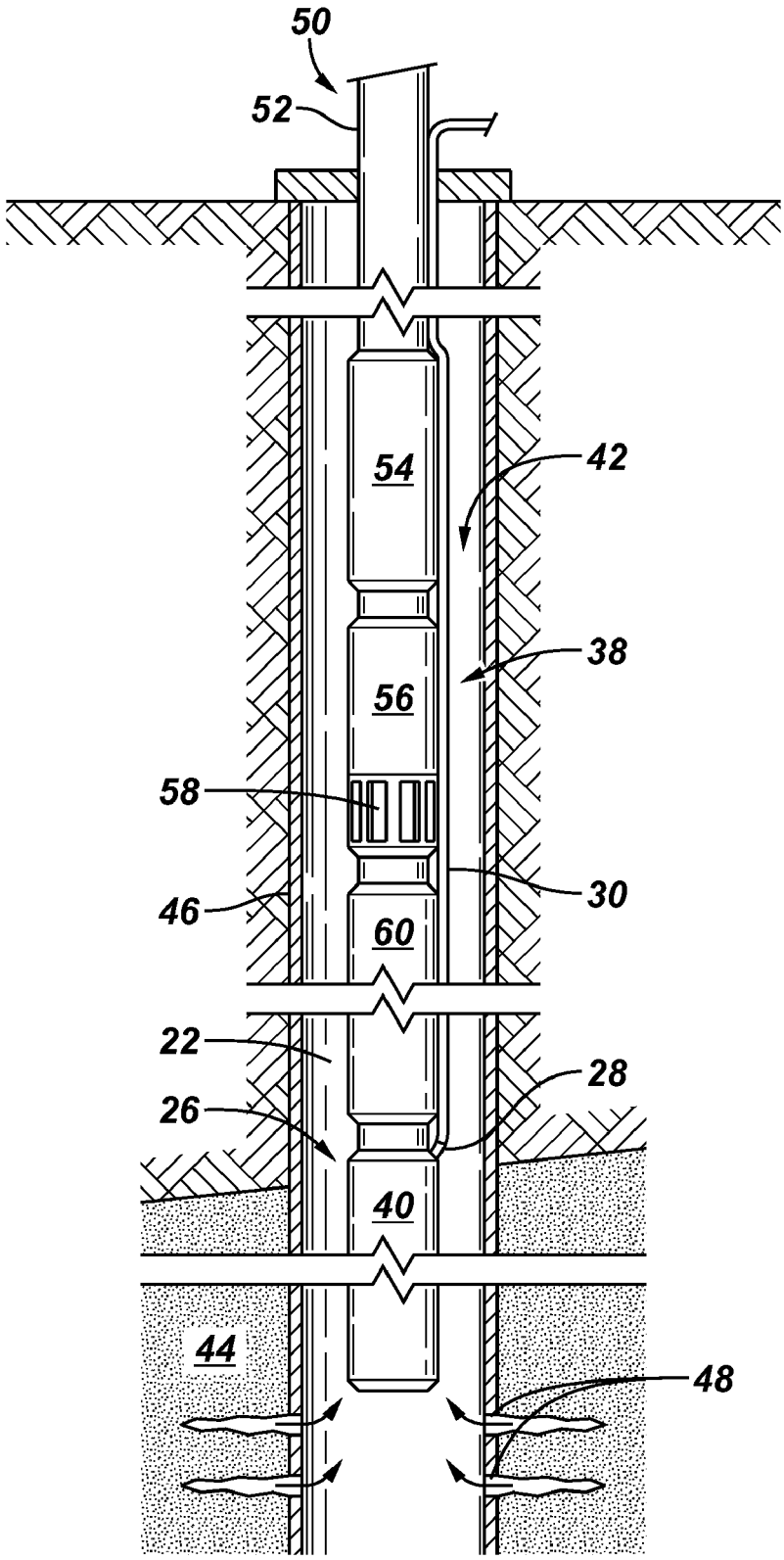
FIG. 2 is a front view of an electric submersible pumping system in which a power cable is coupled to a submersible motor via a connector system, according to an embodiment.

In the embodiment illustrated in FIG. 2, the connector system 28 is used to connect electric cable 30 (in the form of a power cable) to an electric submersible pumping system 38. For example, power cable 30 may be connected to an electric submersible motor 40 used to drive electric submersible pumping system 38. In this particular application, the electric submersible pumping system 38 is deployed in a wellbore 42 drilled into a geological formation 44. The wellbore 42 may be lined with a casing 46 that is perforated with a plurality of perforations 48 to allow well fluid to flow into the interior of casing 46.

The electric submersible pumping system 38 is deployed to a desired location in wellbore 42 via a conveyance 50 which may be in the form of a tubing 52, e.g. coiled tubing, or other suitable conveyance. The system 38 is connected to conveyance 50 by a connector 54 and may comprise a variety of pumping related components. For example, electric submersible pumping system 38 may comprise a submersible pump 56 connected to a pump intake 58. The pump intake 58 allows well fluid to be drawn into submersible pump 56 when pump 56 is powered by submersible motor 40. In many applications, a motor protector 60 is located between submersible motor 40 and pump 56 to enable pressure equalization while isolating motor fluid from well fluid.

In the embodiment illustrated in FIG. 2, the power supplied to submersible motor 40 via electric cable 30 is three-phase power. Regardless of the particular design of submersible motor 40, connector system 28 enables the protected, consistent delivery of electric power from cable 30 to submersible motor 40. Both the electrical cable 30 and the connector system 28 are designed to withstand the wellbore environment which can present harsh temperature, pressure, and/or chemical conditions. It should be noted the submersible motor 40 may be constructed in a variety of sizes and configurations depending on the particular pumping application.

Figure 3:
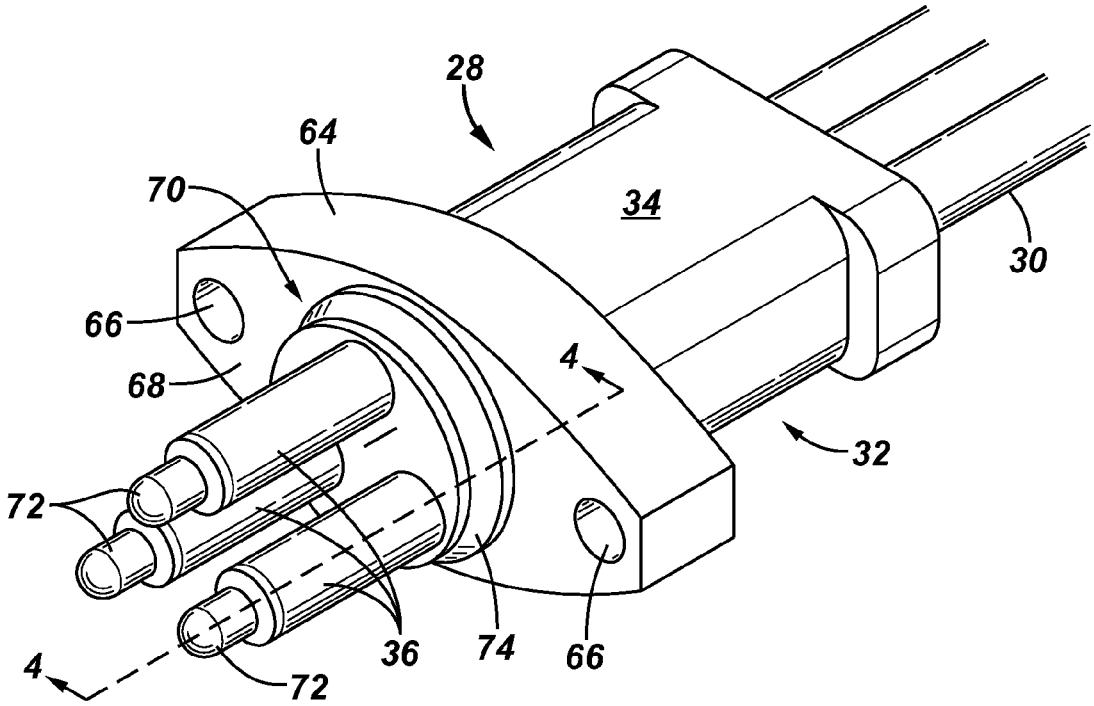
FIG. 3 is an orthogonal view of one example of a connector system, according to an embodiment.
Figure 4:
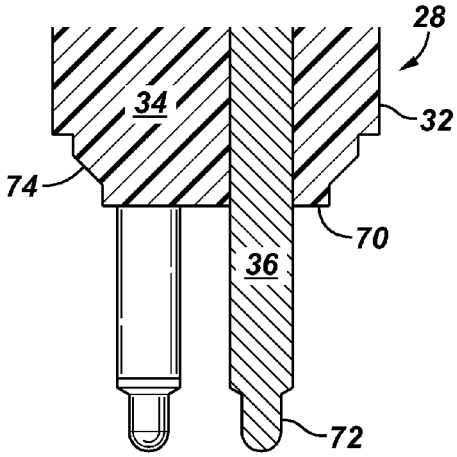
FIG. 4 is a cross-sectional view taken generally along line 4-4 of FIG. 3, according to an embodiment.

Referring generally to FIG. 3, one example of electric connector system 28 is illustrated. In this example, connector body 32 is formed from moldable material 34 that surrounds and seals against the internal portions of conductors 36. The use of moldable material 34 enables a long-lasting, dependable seal and allows construction of connector system 28 without elastomer seals and/or compression blocks within connector body 32, as further illustrated in FIG. 4. In the particular example illustrated, connector body 32 comprises a primary body portion 62 and a flange portion 64 that extends radially outwardly from primary body portion 62. The flange portion may be designed with openings 66 extending therethrough to receive fasteners, e.g. bolts, for securely attaching connector body 32 to submersible component 26. One or more openings 66 may be arranged in a desired pattern to accommodate connection of the fasteners with corresponding openings, such as threaded openings, formed in submersible component 26.

Flange portion 64 presents an engagement face or surface 68 designed to abut against a corresponding engagement region of submersible component 26. In the particular example illustrated, connector body 32 further comprises a mating portion 70 that extends from engagement surface 68 to ensure a seal between connector body 32 and the submersible component 26. The seal formed by mating portion 70 prevents the influx of harmful downhole constituents and protects one or more terminal ends 72 of conductors 36 when those terminal ends 72 are plugged into corresponding receptacles of submersible component 26. In this embodiment, mating portion 70 comprises a mating face 74 which may be designed to present a tapered sealing surface that forms a secure seal between connector body 32 and submersible component 26 even without separate elastomer seal elements.

The flange portion 64, mating portion 70, and mating face 74 may be constructed in a variety of shapes and configurations. For example, mating portion 70 may be extended, recessed, or a combination of extended and recessed portions. Additionally, the mating face 74 may be formed as a tapered sealing surface or as another type of sealing surface designed to form a protective seal when connector body 32 is fully engaged with submersible component 26. In any of these configurations, the primary body portion 62, flange portion 64, mating portion 70, and mating face 74 can be formed as a unitary component from the moldable material 34. Furthermore, the illustrated embodiment shows terminal ends 72 arranged in a triad configuration, but the conductors 36 and terminal ends can be arranged in a variety of other configurations.

Figure 5:
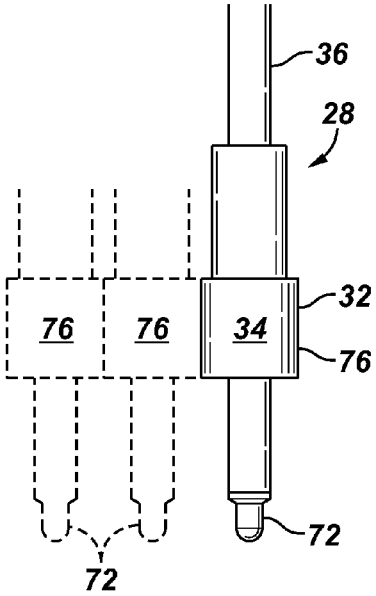
FIG. 5 is a schematic illustration of another example of the connector system, according to an alternate embodiment.

Referring generally to FIG. 5, an alternate embodiment of connector system 28 and connector body 32 is illustrated. In this embodiment, connector body 32 is formed with a plurality of independent connector body portions 76. For example, an independent connector body portion 76 can be formed of moldable material 34 around each independent conductor 36. The connector body portions 76 are then independently fastened to submersible component 26 or connected together and fastened to submersible component 26 as a group.

Figure 6:
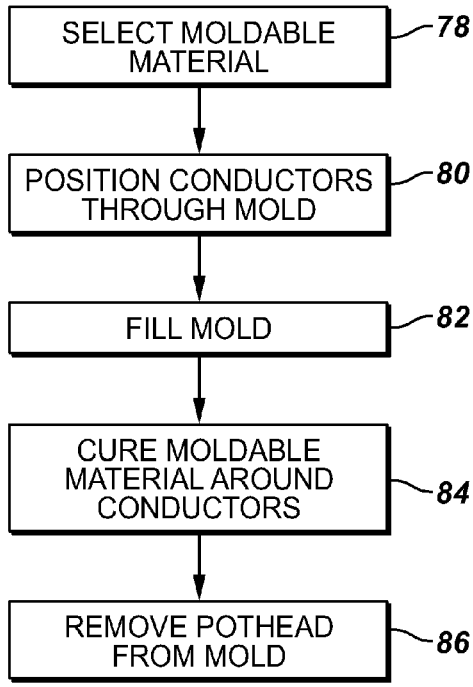
FIG. 6 is a flowchart illustrating one methodology for preparing a connector system for use in a submerged environment, according to an embodiment.

The creation of various connector systems 28 may be accomplished according to various processes. However, one example of a process for forming connection system 28 is illustrated by the flowchart of FIG. 6. In this embodiment, a suitable moldable material is initially selected, as indicated by block 78. The material selected may depend on the subterranean environment in which the connector system is to be utilized. In a wellbore environment, the temperatures, pressures, and fluids or other constituents found in a particular wellbore may affect the type of moldable material selected. For example, certain environments may encourage the selection of moldable thermoplastic materials, thermoset materials, liquid crystal polymer materials, or other suitable materials.

Once the moldable material is selected, conductors 36 are positioned in a mold, as indicated by block 80. The mold is then filled with moldable material, as indicated by block 82. The filling of the mold may be accomplished according to a variety of molding techniques that may vary with the type of moldable material selected. The moldable material is displaced around the internal conductors and forms a seal with those internal conductors when cured, as indicated by block 84. In this particular example, the connector body/pothead 32 is then removed from the mold, as indicated by block 86. Placement of the conductors and construction of the mold are designed to provide extended terminal ends 72 and suitable sealing surfaces, such as mating face 74, to form a lasting and dependable seal with submersible component 26. In some applications, the curing process (or portions of the curing process) may be accomplished after the connector body is removed from the mold.

Depending on the environment and the electric submersible component with which connector body 32 is engaged, the actual materials used and the configuration selected for the connector body may vary. In some applications, for example, individual conductors may be sealed within connector body 32, while in other applications larger numbers of plural conductors, e.g. three conductors, may be sealed in connector body 32. Additionally, the conductors may be formed from copper or other conductive materials and terminate in a variety of terminal ends 72. The flange portion may be constructed in various configurations with different arrangements of openings or other connection features. Additionally, the entire flange portion may be replaced with other types of connection features. In some applications, separate seal elements can be used in cooperation with the connector body; and/or the moldable material may be constructed with a variety of sealing surfaces that enable a desired seal in downhole or other subterranean environments. The conductors, moldable material, and connector body configuration are selected to provide the pressure seal and dielectric strength to carry current to the submersible component, e.g. submersible motor.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for forming an electrical connection in a submerged environment, comprising:

a submersible component powered by electricity; and a connector coupled to the submersible component to enable flow of electric power to the submersible component, the connector having a plurality of conductors and a body formed of moldable material molded around the plurality of conductors, the body comprising a flange, by which the body is fastened to the submersible component, and a mating portion located to form a seal with the submersible component when the body is fastened to the submersible component, the flange and the mating portion being formed of moldable material as a unitary part of the body when the body is molded wherein the unitary part dielectrically insulates and pressure seals a conductive portion of each of the plurality of conductors.

2. The system as recited in claim 1, wherein the submersible component comprises a submersible motor.

3. The system as recited in claim 1, wherein the flange comprises a plurality of openings for receiving fasteners therethrough.

4. The system as recited in claim 1, wherein the mating portion extends from an engagement surface of the body and comprises a tapered sealing surface.

5. The system as recited in claim 1, wherein the body is formed from a thermoset material.

6. The system as recited in claim 1, wherein the body is formed from a thermoplastic material.

7. The system as recited in claim 1, wherein the body is formed from a liquid crystal polymer material.

8. The system as recited in claim 1, wherein the plurality of conductors comprises three conductors having terminal ends that extend from the body.

9. The system as recited in claim 1, wherein the body seals against the plurality of conductors without using separate sealing members.

10. A device, comprising:

a cable having at least two conductors;

a pothead connector body coupled to an end of the cable to enable a sealed, submerged connection with a submersible component, the pothead connector body being formed of a non-metallic material surrounding and sealed against the at least two conductors, the pothead connector body having a flange portion formed of the non-metallic material to enable fastening of the pothead connector body to the submersible component wherein the pothead connector body dielectrically insulates and pressure seals a conductive portion of each of the at least two conductors.

11. The device as recited in claim 10, further comprising the submersible component, the pothead connector body being sealingly connected with the submersible component.

12. The device as recited in claim 10, wherein the cable comprises three conductors and the pothead connector body is molded around the three conductors as a unitary body component.

13. The device as recited in claim 10, wherein the cable comprises three conductors and the pothead connector body is molded around the three conductors as three separate body components.

* * * * *